United States Patent [19]

Piscitelli

[11] Patent Number: 4,780,097

[45] Date of Patent: Oct. 25, 1988

[54] SOCKET CONTACT FOR AN ELECTRICAL CONNECTOR

[75] Inventor: R. Amelia Piscitelli, Sidney, N.Y.

[73] Assignee: Amphenol Corporation, Wallingford, Conn.

[21] Appl. No.: 150,334

[22] Filed: Jan. 29, 1988

[51] Int. Cl.[4] ..... H01R 13/187

[52] U.S. Cl. ..... 439/843; 29/510; 29/882; 403/274; 439/852; 439/879

[58] Field of Search ..... 439/843, 846, 851, 852, 439/879; 29/882, 510, 513; 285/382; 403/274, 282

[56] References Cited

U.S. PATENT DOCUMENTS 4,461,531 7/1984 Davis et al. ..... 439/843

*Primary Examiner*—Gil Weidenfeld
*Assistant Examiner*—Steven C. Bishop
*Attorney, Agent, or Firm*—Bacon & Thomas

[57] ABSTRACT

A socket contact for an electrical connector is disclosed which includes a contact body, a tubular spring member snapped onto the contact body and a protective sleeve telescopically disposed over the spring member. The contact body includes an annular groove and the spring member includes a plurality of circumferentially spaced tabs. The tabs are formed over the groove through the sleeve to prevent axial movement of the spring member relative to the contact body, whereby a highly reliable electrical joint is made between the spring member and the contact body to avoid electrical discontinuities that might otherwise result.

13 Claims, 1 Drawing Sheet

SOCKET CONTACT FOR AN ELECTRICAL CONNECTOR

BACKGROUND OF THE INVENTION

This invention relates to a socket contact for an electrical connector including an arrangement for joining a tubular spring member to the termination end of a machined body.

U.S. Pat. No. 4,447,110 issued on May 8, 1984 to Stephen Punako, et al describes a socket contact characterized by a solid machined contact body and a tubular spring member, including means for securing the spring member to the body. A protective sleeve is telescopically mounted over the tubular spring member. In an arrangement of the type described it is imperative, in order to avoid electrical discontinuities, that a highly reliable joint be provided between the spring member and the termination end of the contact body.

An arrangement featuring a multi-grooved machined contact body receiving corresponding grooves or threads in a sleeve is described in U.S. Pat. No. 4,461,531 issued on July 24, 1984 to Stephen Punako, et al. A socket contact featuring a crimped construction of the sleeve to the terminal end of the contact body via a groove and formed end is known. In this regard reference is made to U.S. Pat. No. 3,383,645 issued on May 14, 1968 to Milanese, et al and U.S. Pat. No. 3,003,135 issued on Oct. 3, 1961 to Purinton.

The use of multiple grooves for joining connector components is shown in other contexts by U.S. Pat. Nos. 3,291,894 issued on Dec. 13, 1966 and 4,209,221 issued on June 24, 1980 to Sampson and Chupak, et al, respectively.

Retention shoulders or tabs and formed sleeve ends for retention are well known as particularly shown by U.S. Pat. Nos. 4,118,093 and 4,262,987 issued on Oct. 3, 1978 and on Apr. 21, 1981 to Obeissort and Gallusser, et al, respectively. The aforenoted patent to Chupak teaches the combination of a formed groove and end.

Socket contacts and/or electrical connectors relating generally to the present invention are shown in U.S. Pat. No. 3,112,149 issued on Nov. 20, 1963 to Bachman; U.S. Pat. No. 3,125,396 issued on Mar. 17, 1964 to Bertram; U.S. Pat. No. 3,544,954 issued on Dec. 1, 1970 to Yeager; U.S. Pat. No. 3,564,487 issued on Jan. 2, 1972 to Upstave, et al; U.S. Pat. No. 3,597,711 issued on Aug 3, 1971 to Buckley, et al; U.S. Pat. No. 4,264,116 issued on Apr. 28, 1981 to Glika, Jr.; U.S. Pat. No. 4,270,825 issued on June 2, 1981 to Marsh; U.S. Pat. No. 4,272,150 issued on June 9, 1981 to Faerborin; and U.S. Pat. No. 4,278,317 issued on July 14, 1981 to Gallusser, et al.

None of the above cited references are seen to teach or suggest the arrangement of the present invention which features a single interfitted groove combined with formed tabs for the purposes intended.

SUMMARY OF THE INVENTION

This invention contemplates a socket contact for an electrical connector including a contact body, a tubular spring member including means to secure the spring member to the body and a sleeve telescopically mounted over the tubular spring member. The contact body includes at least one groove and the spring member includes a plurality of circumferentially spaced tabs. The spring member is snapped onto the contact with the tabs disposed in the area of the groove. The tabs are formed over the groove through the sleeve to prevent axial movement of the spring member, whereby a highly reliable joint is made between the spring member and the contact body to avoid electrical discontinuities that might otherwise result.

Accordingly, there is disclosed herein a socket contact for an electrical connector comprising; a solid contact body having at least one circumferential groove thereon; a tubular spring member snapped over the contact body, said spring member having a plurality of tabs thereupon disposed in the area of the contact body groove; a sleeve member telescopically disposed over the tubular spring member; and the spring member tabs being formed over the groove through the sleeve to prevent axial movement of the spring member for providing a reliable electrical joint between the spring member and the contact body.

DETAILED DESCRIPTION OF THE INVENTION

The present invention contemplates construction of such a socket contact as described comprising a separate socket body, a tubular spring member and an outer guide sleeve.

Figure 1:
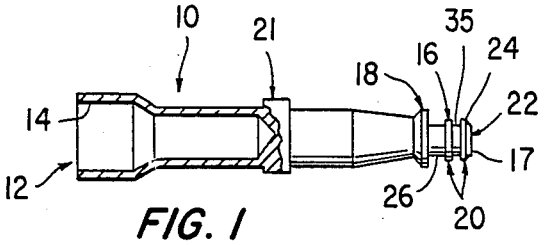
FIG. 1 is a partially sectional view of a socket body component formed according to the teachings of the present invention.

FIG. 1 depicts the socket body 10 which is formed from solid stock material as by machining, die casting, upsetting, or other similar manufacturing process, to include at the rear end 12 thereof having a terminal portion 14 adapted to receive the bared end of an electrical connector for crimping or soldering connection thereto.

The socket contact 10 at its other, forward end is provided with a generally cylindrical projection 16 adjacent to a larger diameter locating shoulder 18. A retention shoulder 21 is formed intermediate either end of the socket body 10. Since the socket body 10 is formed by relatively precision processes, such as machining, the retention shoulder 21 is accurately sized and located, and possesses a relatively high degree of strength and rigidity.

The socket body 10 is constructed of an electrically conductive material, and for crimping to the electrical conductor, may advantageously be constructed of brass, with a suitable surface processing or plating to prevent corrosion.

The projection 16 includes a forward, relatively larger diameter section 20 at the forward end the socket body 10, with an intermediate groove 22 machined or otherwise formed therein. A chamfer 24 may also be provided at the front end of the projection 16.

The projection 16 also includes a reduced diameter section 26 intermediate the larger diameter section 20 and the locating shoulder 18.

Figure 2:
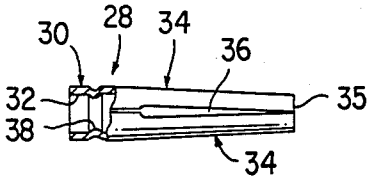
FIG. 2 is a partially sectional view of a tubular spring member formed according to the teachings of the present invention.

Referring to FIG. 2, the spring member 28 is separately manufactured as by forming sheet metal or by drawing or other similar manufacturing methods to provide the generally tubular spring member 28. Adjacent to the rear end 30 of the spring member 28 is an internal diameter 32, which is sized to be fit over the larger diameter section 20 of the socket body 10. The other or forward end is provided with a series of two or more spring fingers 34 formed by a plurality of slots 36 extending axially towards the rear end 30 of the spring member 28. The spring fingers 34 are readily convergent such as to be enabled to exert a spring force on a mating pin contact (not shown) in a manner well known to those skilled in the art.

Figure 4:
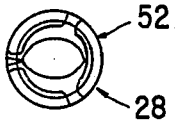
FIG. 4 is an end view of the spring member shown in FIG. 2.
Figure 5:
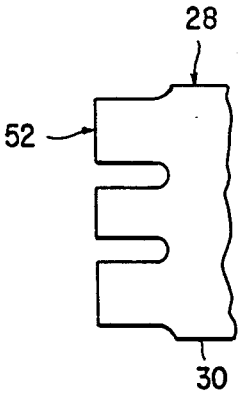
FIG. 5 is a developed view showing a plurality of spring member tabs in the area of a contact body groove.

The spring member 28 is also provided with a circumferential crimp 38 extending radially inward from and adjacent to the internal diameter 32 at the rear end 30 of the spring member 28. This is employed in cooperation with the groove 22 as a locating feature at assembly, and to improve the electrical connection. The rear portion 30 of the spring member 28 terminates in a plurality of tabs 52 shown as three in number in FIGS. 4 and 5, and equally spaced around the circumference of the spring member and having a purpose as will be hereinafter described.

The spring member 28 may be manufactured from beryllium copper or other similar material with a suitable plating thereof such as gold plating, applied to improve the surface conductivity thereof in a manner well known to those skilled in the art.

Figure 3:
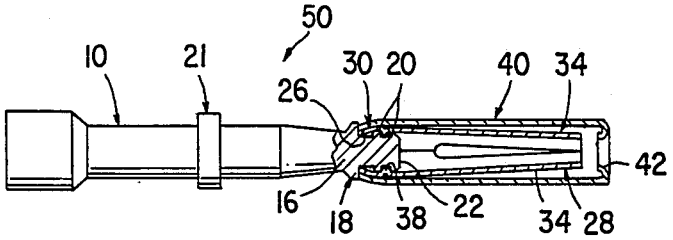
FIG. 3 is a partially sectional view of a socket contact employing the socket body and spring member shown in FIGS. 1 and 2, respectively.
Figure 6:
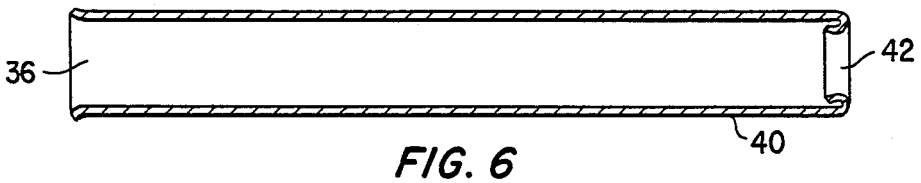
FIG. 6 illustrates a protective sleeve.

FIG. 3 depicts the assembly of the socket body 10 to the spring member 28 and an outer protective sleeve 40 as shown in FIG. 6 to form a completed socket contact 50.

The particular arrangement of a solid contact characterized by contact body 10, tubular spring member 28 and protective sleeve 40 is described in substantial detail in the aforenoted U.S. Pat. No. 4,461,531. Only as much of the arrangement as is necessary for understanding the present invention has been described herein.

The protective sleeve 40 illustrated in FIG. 6 is used to protect spring fingers 34 of tubular spring member 28 shown in FIG. 2. Sleeve 40 may be of material such as stainless steel and includes a forward end 42 which has been rolled inwardly to provide means for guiding a pin type contact (not otherwise shown) into the sleeve. The opposite end 36 of sleeve 40 is slightly flared so that it may be disposed over contact body 20 shown in FIG. 1 where it may then be rolled into groove 26 of the contact body.

When using a socket contact of the type so far described it is imperative that a highly reliable joint be made between spring member 28 and the groove end of contact body 10 in order to avoid electrical discontinuities that might otherwise occur. The present invention uses tabs 52 shown in FIGS. 4 and 5 for this purpose. Tabs 52 are stamped on the rear portion 30 of spring member 28 so as to provide relief for the spring material when the tabs are formed over groove 26 of contact body 10 as shown in FIG. 7.

Figure 7:
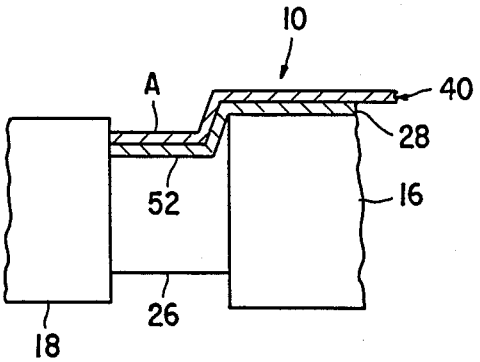
FIG. 7 illustrates the feature of the invention whereby the spring member tabs are formed over the contact body groove through the protective sleeve.

With further reference to FIG. 7, spring member 28 snaps over contact body 10 so that tabs 52 are in the area of groove 26. Sleeve 40 is disposed over spring 28. Thereafter tabs 52 are formed over groove 26 through sleeve 40 as also shown in FIG. 7, whereby the resulting groove and formed tab arrangement prevents axial movement of spring member 28. The aforenoted forming over is accomplished by conventional means such as crimping or the like as at A in the Figure.

There has thus been described a socket contact for an electrical connecter in which a groove in a machined contact body combined with tabs on a formed spring member is used to join the spring member to the termination end of the machined contact body for producing a highly reliable electrical connection between the spring member and the contact body.

With the above description of the invention in mind reference is made to the claims appended hereto for a definition of the scope of the invention.

What is claimed is:

1. A socket contact for an electrical connector, comprising:

a solid contact body having at least one circumferential groove thereon;

a tubular spring member snapped over the contact body, said spring member having a plurality of tabs thereupon disposed in the area of the contact body groove;

a sleeve member telescopically disposed over the tubular spring member; and the spring member tabs being formed over the groove through the sleeve to prevent axial movement of the spring member for providing a reliable electrical joint between the spring member and the contact body.

2. A socket contact as described by claim 1, wherein: the tabs in the plurality of tabs are spaced around the circumference of the spring member at a rear portion thereof.

3. A socket contact as described by claim 2, wherein: the plurality of tabs includes at least three tabs.

4. A socket contact as described by claim 1, wherein: the tabs in the plurality of tabs are spaced around the circumference of the spring at a rear portion thereof so as to provide relief for the spring material when the tabs are formed over the groove.

5. A socket contact as described by claim 4, wherein: the plurality of tabs includes at least three tabs.

6. In a socket contact for an electrical connector of the type including a solid contact body having a circumferential groove thereon, a tubular spring member snapped over the contact body, and a sleeve telescopically disposed over the tubular spring member, the improvement comprising:

the tubular spring member having a plurality of tabs, said tabs disposed in the area of the contact body groove when the spring member is snapped thereover; and the tabs being formed over the groove through the sleeve to prevent axial movement of the spring member for providing a reliable electrical joint between said spring member and the contact body.

7. A socket contact as described by claim 6, wherein: the tabs in the plurality of tabs are spaced around the circumference of the spring member at a rear portion thereof.

8. A socket contact as described by claim 7, wherein: the plurality of tabs includes at least three tabs.

9. A socket contact as described by claim 6, wherein: the tabs in the plurality of tabs are spaced around the circumference of the spring at a rear portion thereof so as to provide relief for the spring material when the tabs are formed over the groove.

10. A socket contact as described by claim 9, wherein:

the plurality of tabs includes at least three tabs.

11. A method for providing a socket contact for an electrical connector, comprising:

providing a solid contact body;

providing a circumferential groove on the solid contact body;

snapping a tubular spring member over the contact body so that a plurality of tabs circumferentially spaced around the spring member are in the area of the contact body groove;

telescopically disposing a sleeve over the tubular spring member; and forming the spring member tabs over the groove through the sleeve for preventing axial movement of the spring member and for providing a reliable electrical joint between the spring member and the contact body.

12. A method for providing a socket contact as described by claim 11, including:

circumferentially spacing the tabs around the spring member at a rear portion thereof.

13. A method for providing a socket contact as described by claim 12, including:

circumferentially spacing the tabs around the spring member at the rear portion thereof for relieving the spring member material when forming the tabs over the groove.

* * * * *